US011359466B2

(12) United States Patent
Yang et al.

(10) Patent No.: US 11,359,466 B2
(45) Date of Patent: Jun. 14, 2022

(54) PERFORATING DEVICE FOR HORIZONTAL WELLS

(71) Applicants: Sinopec Oilfield Service Corporation, Beijing (CN); Sinopec Oilfield Service Jianghan Corporation, Qianjiang (CN); Logging Company, Sinopec Oilfield Service Jianghan Corporation, Qianjiang (CN)

(72) Inventors: Guosheng Yang, Qianjiang (CN); Yong Liao, Qianjiang (CN); Zhihua Zhang, Qianjiang (CN); Liang Ye, Qianjiang (CN); Jiang Zhu, Qianjiang (CN); Haitao Rao, Qianjiang (CN); Jinguo Pan, Qianjiang (CN); Siping Chen, Qianjiang (CN); Yuanhui Shi, Qianjiang (CN); Yijiang Feng, Qianjiang (CN); Peiwen Gu, Qianjiang (CN); Chao Lu, Qianjiang (CN); Zhongxin Fan, Qianjiang (CN); Zhi Li, Qianjiang (CN); Chaohui Zhang, Qianjiang (CN)

(73) Assignees: SINOPEC OILFIELD SERVICE CORPORATION, Beijing (CN); SINOPEC OILFIELD SERVICE JIANGHAN CORPORATION, Qianjiang (CN); LOGGING COMPANY, SINOPEC OILFIELD SERVICE JIANGHAN CORPORATION, Qianjiang (CN)

( * ) Notice: Subject to any disclaimer, the term of this patent is extended or adjusted under 35 U.S.C. 154(b) by 0 days.

(21) Appl. No.: 17/013,637

(22) Filed: Sep. 6, 2020

(65) Prior Publication Data

US 2020/0408074 A1 Dec. 31, 2020

Related U.S. Application Data

(63) Continuation-in-part of application No. PCT/CN2019/080710, filed on Apr. 1, 2019.

(30) Foreign Application Priority Data

Oct. 19, 2018 (CN) ..... 201811220806.6

(51) Int. Cl.
*E21B 43/116* (2006.01)
*E21B 17/02* (2006.01)
(Continued)

(52) U.S. Cl.
CPC ..... *E21B 43/116* (2013.01); *E21B 17/021* (2013.01); *E21B 17/06* (2013.01);
(Continued)

(58) Field of Classification Search
CPC .... E21B 17/021; E21B 17/06; E21B 17/1021; E21B 23/14; E21B 43/116; E21B 43/119; E21B 47/092
See application file for complete search history.

(56) References Cited

U.S. PATENT DOCUMENTS

2002/0100360 A1* 8/2002 Rochen ..... E21B 43/116 89/1.15
2002/0104686 A1* 8/2002 Bloom ..... E21B 23/00 175/99
(Continued)

FOREIGN PATENT DOCUMENTS

CN 203847080 U * 9/2014
CN 109098678 A * 12/2018
(Continued)

*Primary Examiner* — Jennifer H Gay
(74) *Attorney, Agent, or Firm* — Matthias Scholl P.C.; Matthias Scholl

(57) ABSTRACT

A perforating device includes a release sub, a rotating segment, a first centralizer, a braking segment, a casing
(Continued)

collar locator, a traction mechanism, a second centralizer, a flex joint, a power supply segment, a shock absorber, a perforator, and a tail segment, which are in threaded connection sequentially to each other. The first joint assembly includes a first joint, a guide key, a connecting sleeve including a locking groove, a second joint, and an outer pipe; the first joint of the first joint assembly is in threaded connection to the cable bridle, and the second joint is in threaded connection to the outer pipe. The connecting sleeve is disposed inside the outer pipe and is connected to the first joint through the guide key. The second joint assembly includes a plurality of locking claws, a third joint, and a head.

9 Claims, 5 Drawing Sheets

(51) Int. Cl.

| | |
|---|---|
| ***E21B 43/119*** | (2006.01) |
| ***E21B 17/10*** | (2006.01) |
| ***E21B 23/14*** | (2006.01) |
| ***E21B 47/092*** | (2012.01) |
| ***E21B 17/06*** | (2006.01) |

(52) U.S. Cl.
CPC ..... *E21B 17/1021* (2013.01); *E21B 23/14* (2013.01); *E21B 43/119* (2013.01); *E21B 47/092* (2020.05)

(56) References Cited

U.S. PATENT DOCUMENTS

| | | | | |
|---|---|---|---|---|
| 2005/0247488 | A1* | 11/2005 | Mock | E21B 4/18 175/99 |
| 2005/0263280 | A1* | 12/2005 | Sellers | E21B 23/01 166/255.1 |
| 2007/0181298 | A1* | 8/2007 | Sheiretov | E21B 17/1021 166/212 |
| 2008/0308318 | A1* | 12/2008 | Moore | E21B 4/04 175/51 |
| 2010/0286800 | A1* | 11/2010 | Lerche | E21B 47/12 700/90 |
| 2015/0167416 | A1* | 6/2015 | Ludwig | E21B 4/006 166/385 |
| 2016/0108689 | A1* | 4/2016 | Negre | G01V 1/52 166/377 |
| 2017/0145760 | A1* | 5/2017 | Poyet | E21B 23/14 |
| 2017/0167204 | A1* | 6/2017 | Drenth | E21B 17/023 |
| 2017/0191327 | A9* | 7/2017 | Motland | E21B 43/11 |
| 2018/0187504 | A1* | 7/2018 | Boge | E21B 23/14 |
| 2018/0355682 | A1* | 12/2018 | Pessin | E21B 19/084 |
| 2020/0408074 | A1* | 12/2020 | Yang | E21B 23/14 |

FOREIGN PATENT DOCUMENTS

| | | | | | |
|---|---|---|---|---|---|
| CN | 109184630 | A | * | 1/2019 | |
| CN | 208966226 | U | * | 6/2019 | |
| CN | 208966300 | U | * | 6/2019 | |
| CN | 111622728 | A | * | 9/2020 | |
| GB | 2412398 | A | * | 9/2005 | E21B 17/1021 |
| WO | WO-2021136931 | A | * | 7/2021 | E21B 29/10 |

* cited by examiner

PERFORATING DEVICE FOR HORIZONTAL WELLS

CROSS-REFERENCE TO RELATED APPLICATIONS

This application is a continuation-in-part of International Patent Application No. PCT/CN2019/080710 with an international filing date of Apr. 1, 2019, designating the United States, now pending, and further claims foreign priority benefits to Chinese Patent Application No. 201811220806.6 filed Oct. 19, 2018. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to the field of perforation in petroleum engineering, and more particularly to a perforating device for hydraulic cable-conveyed perforating in a horizontal well.

In the existing horizontal-well perforating technology of petroleum engineering, the perforating methods include hydraulic cable-conveyed perforating and coiled tubing conveyed perforating. The hydraulic cable-conveyed perforating uses a pump truck to pump or compress fluids, allowing the perforating tool string to move to the bottom of a well. The coiled tubing conveyed perforating uses flexible tubes to directly convey the perforating tool string.

The hydraulic cable-conveyed perforation requires hydraulic channels, and is difficult to perforate in the first section of a well, and difficult to seal the well after perforation. In the coiled tubing conveyed perforating, the tubing tends to twist in the horizontal well, and thus the depth measurement cannot be obtained precisely, leading to engineering problems such as perforation on the casing collar. In addition, the coiled tubing is heavy and bulky, the installation and disassembly thereof are arduous and time-consuming, and the transportation thereof is costly.

SUMMARY

The disclosure provides a perforating device adapted for operating in various working conditions. The perforating device is advantageous in reducing the operation time and the work intensity of perforation in a horizontal well, and improving the perforation efficiency.

A perforating device comprises a release sub, a rotating segment, a first centralizer, a braking segment, a casing collar locator (CCL), a traction mechanism, a second centralizer, a flex joint, a power supply segment, a shock absorber, a perforator, and a tail segment, which are in threaded connection sequentially to each other. The release sub is connected to a cable bridle.

The first joint assembly comprises a first joint, a guide key, a connecting sleeve comprising a locking groove, a second joint, and an outer pipe; the first joint of the first joint assembly is in threaded connection to the cable bridle, and the second joint is in threaded connection to the outer pipe; the connecting sleeve is disposed inside the outer pipe and is connected to the first joint through the guide key. The second joint assembly comprises a plurality of locking claws, a third joint, and a head; the plurality of locking claws corresponds to the locking groove of the first joint assembly; the plurality of locking claws is fixed on the third joint by a screw pin, and evenly disposed between the head and the third joint.

The first centralizer and the second centralizer are identical in structure, and each comprises a first connector, a second connector, a rotating shaft, a first spring sleeve, a second spring sleeve, a bearing, a supporting arm, two compression caps, two pushing rods, two springs, and four centering arms each comprising a supporting arm; the rotating shaft passes through inner holes of the first spring sleeve and the second spring sleeve, and the first connector and the second connector are disposed on both ends of the rotating shaft, respectively; the first spring sleeve and the second spring sleeve are movable back and forth on the rotation shaft, and the two springs are provided between the first and second spring sleeve and the rotating shaft, respectively; the two compression caps are in threaded connection to the first and second spring sleeves to compress the two springs, respectively; the two pushing rods are disposed on one end of the first and second spring sleeves, respectively; the four centering arms are disposed between the first spring sleeve and the second spring sleeve; one end of the supporting arm of each centering arm is fixed on one of the two pushing rods by a first steel pin, and another end is fixed on the bearing; the bearing is disposed between two supporting arms and fixed by a second steel pin.

The braking segment comprises a first brake joint, a second brake joint, and a brake control mechanism disposed between the first brake joint and the second brake joint; the brake control mechanism comprises a motor assembly, a first pushing rod, a spring, two supporting arms, a pushing block, a brake claw; one end of each of the two supporting arms is fixed on a center of the brake claw via a third steel pin, and another end of each of the two supporting arms is fixed on the pushing block via a fourth steel pin; the spring is disposed between the first pushing rod and the pushing block, and the first pushing rod is connected to the motor assembly.

The perforating device is adapted to various working conditions, such as initial perforation in the first section of a well, reperforation after sealing the well from another by a bridge plug, and perforation in a horizontal well having high horizontal displacement to vertical depth ratio. The perforating device is advantageous in reducing the operation time and the work intensity of perforation in a horizontal well, and improving the perforation efficiency.

DETAILED DESCRIPTION OF THE EMBODIMENTS

To further illustrate, embodiments detailing a perforating device are described below. It should be noted that the following embodiments are intended to describe and not to limit the disclosure.

Figure 1:
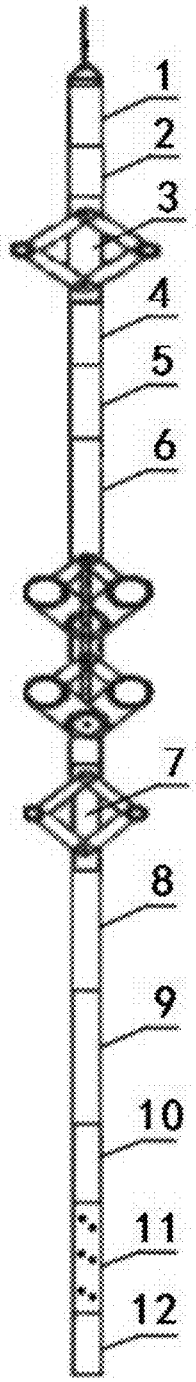
FIG. 1 is a schematic diagram of a perforating device in accordance with one embodiment of the disclosure.
Figure 2:
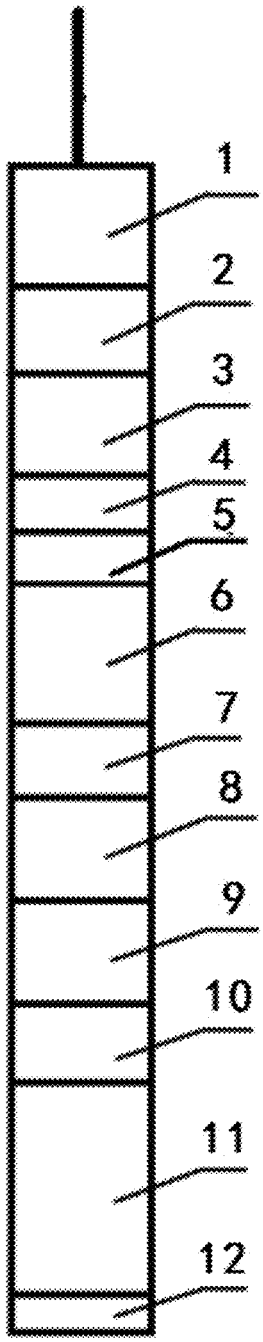
FIG. 2 is a sketch drawing of a perforating device in accordance with one embodiment of the disclosure.

As shown in FIGS. 1 and 2, a perforating device comprises a release sub 1, a rotating segment 2, a first centralizer 3, a braking segment 4, a casing collar locator (CCL) 5, a traction mechanism 6, a second centralizer 7, a flex joint 8, a power supply segment 9, a shock absorber 10, a perforator 11, and a tail segment 12 are in threaded connection sequentially to each other. The release sub is quickly and easily connected to a cable bridle.

Figure 3:
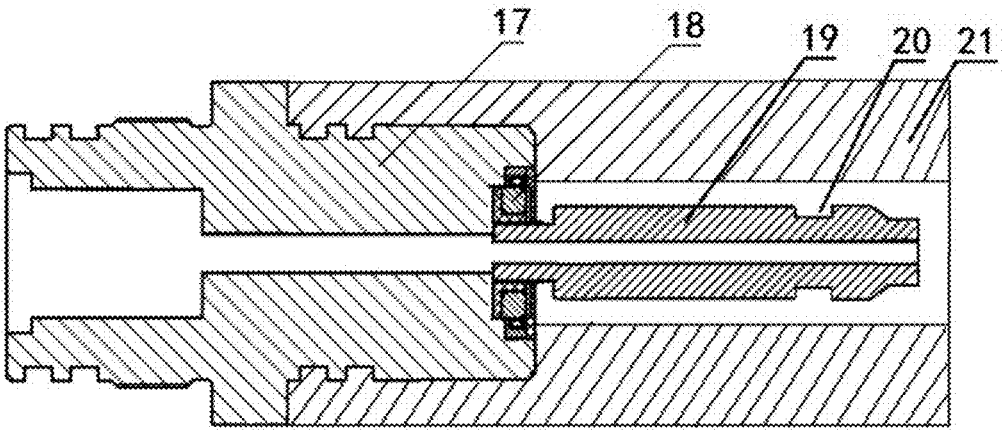
FIG. 3 is a schematic diagram of a first joint assembly of a release sub in accordance with one embodiment of the disclosure.
Figure 4:
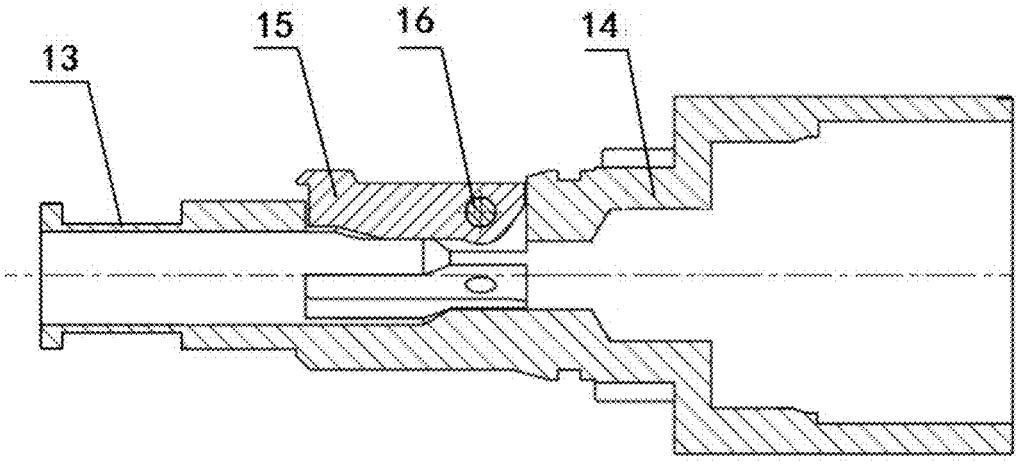
FIG. 4 is a schematic diagram of a second joint assembly of a release sub in accordance with one embodiment of the disclosure.

As shown in FIGS. 3 and 4, the release sub 1 comprises a first joint assembly and a second joint assembly. The first joint assembly comprises a first joint 17, a guide key 18, a connecting sleeve 19 comprising a locking groove 20, a second joint, and an outer pipe 21; the first joint 17 of the first joint assembly is in threaded connection to the cable bridle, and the second joint is in threaded connection to the outer pipe 21; the connecting sleeve 19 is disposed inside the outer pipe 21 and is connected to the first joint 17 through the guide key 18.

The second joint assembly comprises a plurality of locking claws 15, a third joint 14, and a head 13; the plurality of locking claws 15 corresponds to the locking groove 20 of the first joint assembly; the plurality of locking claws 15 is fixed on the third joint 14 by a screw pin 16, and evenly disposed between the head 13 and the third joint 14.

The second joint assembly is provided with three locking claws 15 evenly distributed between the head 13 and the third joint 14 of the second joint assembly, each two of which forms an included angle of 120 degrees.

Before pushing the release sub down a well, the head 13 is inserted into the outer pipe 21; the connecting sleeves 19 is inserted into the head 13; and the locking claws 15 are embedded in the locking groove 20 to form an entire structure that can withstand a pulling force of 10,000 Newtons without detaching.

When the perforating device cannot be pushed down a well to deliver the tools downhole, a command issued from the ground station directs the perforating device to correct questions. The plurality of locking claws is disengaged from the locking groove. The first joint assembly glides off from the second joint assembly, and is lifted out of the wellhead by the cable. But the second joint assembly is left on the perforating device. The perforating device can be lifted out of the wellhead by using a salvage tool connected to the second joint assembly.

The rotating segment 2 comprising a first joint, a rotating assembly, a central shaft and a second joint. The rotating assembly is in threaded connection to the first joint, and is provided with a rotating part allowing 360 rotation. The central shaft is connected to the rotating part via a connecting sleeve, and in threaded connection to the second joint, thus realizing relatively free rotation between the first joint and the second joint.

The first joint of the rotating segment is in threaded connection to the release sub. When the perforating device is pushed down the well, the cable twists to produce a torque, and the first joint rotates in coordination with the torque, leaving the original state of all other components connected to the second joint unchanged. Therefore, torque is released, and the cables are not damaged when going down the well.

The rotational torque is generated when the perforating device is lifted from the well. The second joint rotates in the direction of the rotational torque, leaving the original state of the first joint connected to the second joint unchanged. Therefore, there is no slacks in each of threaded connection between the components due to the release of rotational torque.

Figure 5:
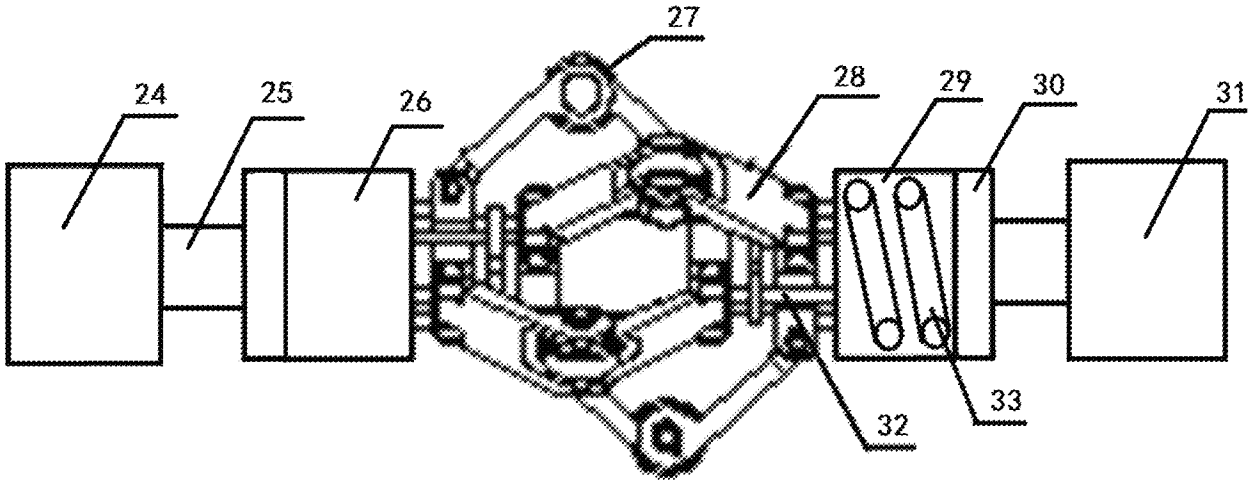
FIG. 5 is a schematic diagram of a centralizer in accordance with one embodiment of the disclosure.

The first centralizer 3 and the second centralizer 7 of the perforating device are identical in structure, and each comprises a first connector 24, a second connector 31, a rotating shaft 25, a first spring sleeve 26, a second spring sleeve 29, a bearing 27, a supporting arm, two compression caps 30, two pushing rods 32, two springs 33, and four centering arms each comprising a supporting arm. As shown in FIG. 5, the rotating shaft 25 passes through the inner holes of the first spring sleeve 26 and the second spring sleeve 29, and the first connector 24 and the second connector 31 are disposed on both ends of the rotating shaft 25, respectively. The spring sleeves are movable back and forth on the rotation shaft, and two springs 33 are provided between the first and second spring sleeves and the rotating shaft 25, respectively. The two compression caps 30 are in threaded connection to the first and second spring sleeves to compress the two springs, respectively. The two pushing rods 32 are disposed on one end of the first and second spring sleeves.

The four centering arms are disposed between the first spring sleeve 26 and second spring sleeve 29. One end of the supporting arm 28 of each centering arm is fixed on one of the two pushing rods 32 by a first steel pin, and another end is fixed on the bearing 27. The bearing is disposed between two support arms and fixed by a second steel pin.

The four entering arms are evenly distributed on the rotating shaft, each two of which forms an included angle of 90 degrees. The opening angle of the centering arms can be adjusted by compressing the spring via the spring sleeves, and the supporting force of each centering arm is 50 kg±2 kg. The design ensures that the perforating device is centered in the horizontal well where reduces the frictional resistance during transport, and improves the ability of the traction mechanism to carry tools.

Figure 6:
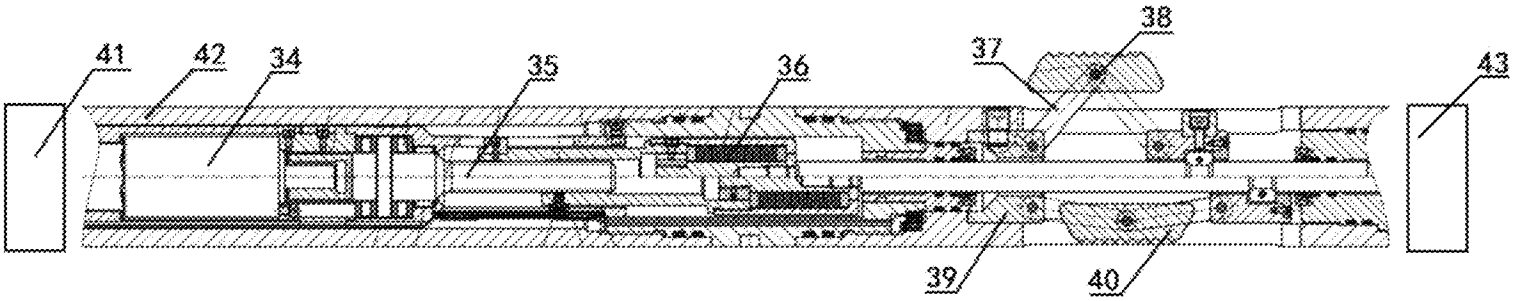
FIG. 6 is a schematic diagram of a brake joint in accordance with one embodiment of the disclosure.

As shown in FIG. 6, the braking segment 4 comprises a first brake joint 41 and a second brake joint 43, and a brake control mechanism 42 disposed between the first brake joint 41 and the second brake joint 43. The brake control mechanism comprises a motor assembly 34, a first pushing rod 35, a spring 36, two supporting arms 37, a pushing block 39, a brake claw 40. One end of each of the two supporting arms 37 is fixed on a center of the brake claw 40 via a third steel pin, and another end of each of the two supporting arms is fixed on the pushing block 39 via a fourth steel pin; the spring 36 is disposed between the first pushing rod 35 and the pushing block, and the first pushing rod is connected to the motor assembly 34. The motor assembly employs the commonly used motor assembly.

When the brake claw 40 needs to be stretched, the motor assembly 34 drives the first pushing rod 35 to move laterally, and the spring 36 is compressed and pushes the pushing block 39 to move forward, thereby driving the brake claw to spread upwards. The stretching distance determines the frictional resistance generated between the brake claw and the well wall. The maximum frictional resistance is not less than 400 kg, ensuring that the perforating device continues in its state of rest, or of uniform motion.

When the brake claw 40 needs to be retracted, the motor assembly drives the first pushing rod 35 to move laterally in the opposite direction, and the spring 36 is reset. Each of the two supporting arms drive the brake claw to retract downwards and return to the braking segment.

When the perforating device passes an upslope section of a horizontal well or performs a perforation, the perforating device may slide down with an acceleration due to its own force of gravity and the explosive force, thus leading to serious cable damage and causing the perforating device to fall down the well. But the frictional resistance generated by the braking segment can keep the perforating device in a state of rest during perforation or a state of uniform motion on the upslope section of the horizontal well, preventing the accidents from occurring.

The casing collar locator 5 comprising a first magnetic joint, a probe, and a second magnetic joint. The first magnetic joint is in threaded connection to the braking segment. The probe comprises a coil winding around a soft iron core and two permanent magnetic steels, and the two permanent magnetic steels are fixed on both ends of the coil winding, respectively, with identical polar orientation.

When the magnetic joint passes through the casing collar in the well, there is a change in magnetic flux through the permanent magnetic steels of the probe. A corresponding change in the magnetic field lines passing through the coil induces an electromotive force in the coil, so that the position of the perforating device in the well can be determined by the induced electromotive force.

Figure 7:
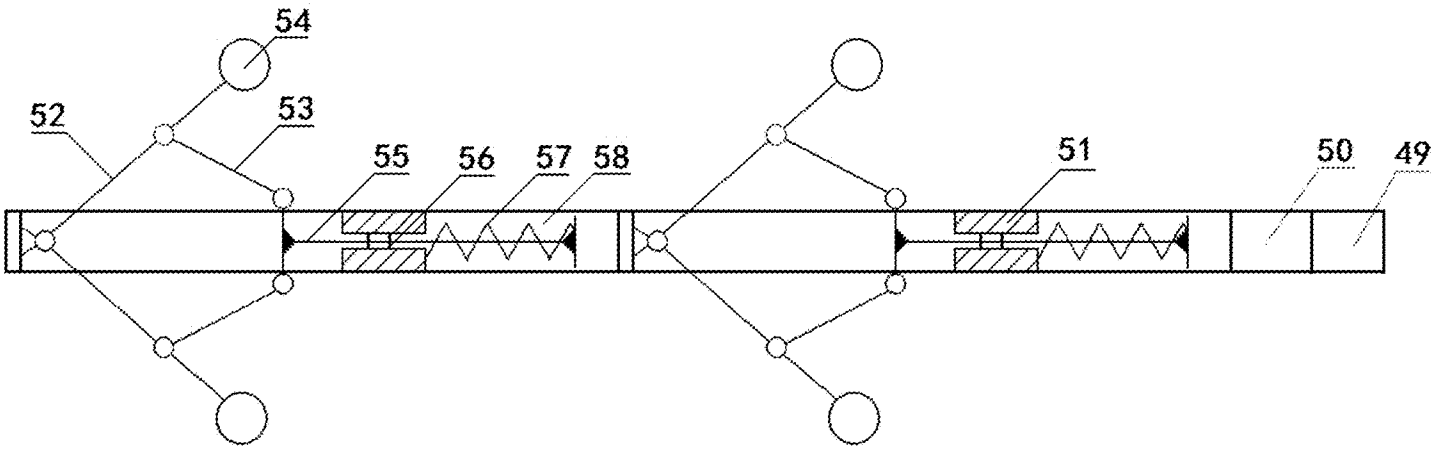
FIG. 7 is a schematic diagram of a traction mechanism in accordance with one embodiment of the disclosure.

As shown in FIG. 7, the traction mechanism 6 comprises a hydraulic control system 49, a hydraulic pushing system 50 and a plurality of drive sections 51; the hydraulic control system is a control device that pressurizes the hydraulic oil in the hydraulic pushing system and transports the hydraulic oil into a hydraulic cylinder 58.

The plurality of drive sections each comprises a primary arm, a secondary arm, a second pushing rod 55, a seal ring 56, a spring 57, and a hydraulic cylinder. One end of the primary arm 52 is fixed on a corresponding drive section 51 by a fifth steel pin, and another end is connected to a driving wheel 54. One end of the secondary arm 53 is connected to the primary arm by a sixth steel pin, and another end is connected to the second pushing rod 55 driving the primary arms to stretch or retract. The second pushing rod is extendable into the hydraulic cylinder 58, and the seal ring 56 is disposed between the second pushing rod and an inner wall of the corresponding drive section. The seal ring is used to isolate the liquid in the horizontal well, preventing the liquid from entering the hydraulic cylinder. And the spring 57 is connected to the second pushing rod. When the pressure inside the hydraulic cylinder drops to a low level, the primary arm and the secondary arm automatically retracted because the spring resets itself.

The hydraulic control system 49 controls the hydraulic pushing system 50 to transports the pressurized hydraulic oil into the hydraulic cylinder, thus driving the second pushing rod 55 to compress the spring 57, driving the secondary arm 53 to move forward and driving the primary arm to moves upward and extend. A drive wheel is closely attached to the horizontal well wall and applies pressure to the well wall. The applied pressure depends on the pressure of the hydraulic oil in the hydraulic cylinder.

The hydraulic control system 49 controls the hydraulic pushing system 50 to transports the pressurized hydraulic oil in the hydraulic cylinder back into the hydraulic pushing system, then the spring resets itself, thus driving the second pushing rod and the secondary arm to move backward, driving the primary arm to retract downward and return to the corresponding drive section, and further stopping the traction mechanism.

Figure 8:
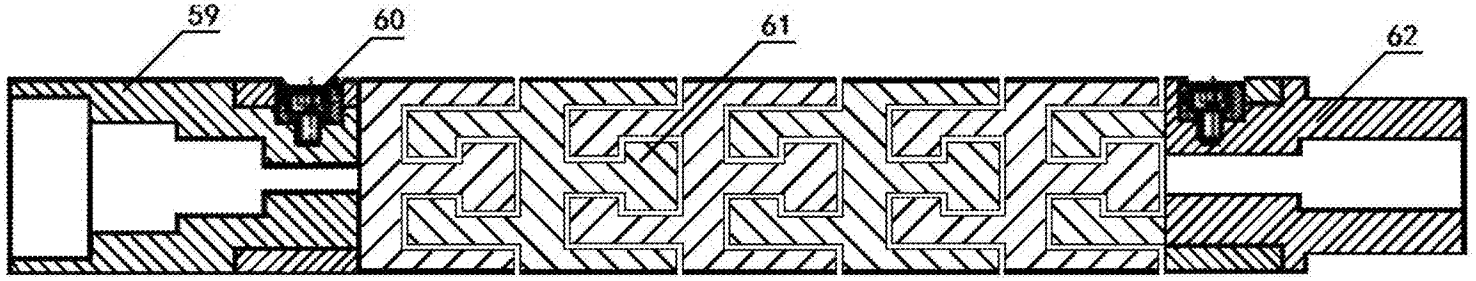
FIG. 8 is a schematic diagram of a flex joint in accordance with one embodiment of the disclosure.

As shown in FIG. 8, the flex joint 8 comprises a first flexible joint 62, a second flexible joint 59, and a core assembly disposed between the first flexible joint and the second flexible joint by four screws 60. The first flexible joint is in threaded connection to a second centralizing joint of the second centralizer.

The core assembly is disposed on a wall of the flex joint and comprises a plurality of flexible parts. Each flexible part comprises a plurality of T-shaped incisions reversely connected to one another, and an area between the T-shaped incisions forms a flexible embroidery. The flexible embroidery is movable or rotatable in the area of the T-shaped incision. The flex joint is flexible in any direction of the space, with a flexible angle of less than 10 degrees, and an ability to withstand a tensile pressure of 45000 kg, thus allowing the perforating device to move freely in the deflecting section of a horizontal well.

The core assembly comprises five flexible parts formed with a laser and disposed on the wall of the flex joint; each flexible part comprises four incisions reversely connected to one another. And a width of each incision is 2 mm±1 mm.

The power supply segment 9 of the disclosure comprises a safety power supply conversion unit. The safety power supply conversion unit comprises a cable driving circuit, a signal receiving circuit, a data encoding and decoding circuit, a mechanical control circuit, an electronic control circuit and a power supply circuit. The mechanical control circuit disposed on both ends of the electronic control circuit is connected to a traction mechanism and a perforating device. The electronic control circuit is connected to the power supply circuit and the mechanical control circuit. The signal receiving circuit and the cable driving circuit are connected to the data encoding and decoding circuit and a single-chip microcomputer. The single-chip computer is connected to a motor. A mechanical switch controlled by the mechanical control circuit comprises a control unit, a motor, a moving contact, a switch contact and a spring. The spring pushed the switch contact away from the contact so that the mechanical switch always turns off. An instrument barrel is in threaded connection to a first joint and a second joint. The mechanical switch is disposed in the instrument barrel. The first joint is in threaded connection to a flex joint.

When the mechanical switch is in the closed state, the control unit controls the moving contact to undergo a circular motion in a counterclockwise direction. The moving contact is propelled down and compresses the switch contact downward, causing the mechanical switch to turns off and providing a power supply path for the perforating device. When the mechanical switch is in the opened state, the moving contact continues to undergo a circular motion in a counterclockwise direction. When the moving contact is disconnected to the static contact, the static contact makes mechanical switch is in the opened state because the spring resets itself. Therefore, the power source segment can prevent high voltages from being applied to the perforating device when the traction mechanism is in operation, which avoids causing damage to the perforating device or performing perforation by mistake.

Figure 9:
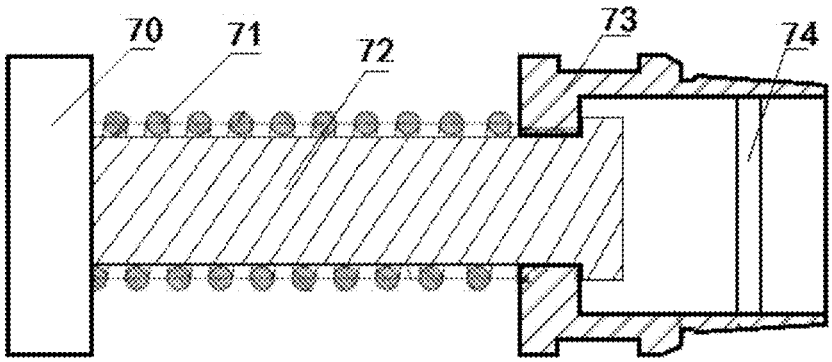
FIG. 9 is a schematic diagram of a shock absorber.

As shown in FIG. 9, the shock absorber 10 comprises a first damping joint 70, a spring 71, a sliding sleeve 72, a second damping joint 73, and a retaining ring 74. One end of the sliding sleeve 72 is connected to the first damping joint 70, and another end extends into the second damping joint 73. The spring 71 is disposed outside the sliding sleeve, and the retaining ring 74 is disposed inside the second damping joint. The distance between the sliding sleeve end and the retaining ring, that is: the distance one end of the sliding sleeve 72 moves in the second damping joint is greater than the maximum compression length of the spring. When the explosive force generated during the perforation operation is released to the first damping joint, the first damping joint compresses the spring to reduce the impact of the explosive force on the perforating device.

The perforator 11 is a commonly used perforator comprising a bullet rack, a first positioning ring, and a second positioning ring. The bullet rack is welded between the first positioning ring and the second positioning ring. The bullet rack is a hollow cylindrical steel body, and the bullet holes with the same diameter are spirally disposed on a surface of the steel body at an angle of 60 degrees. Two holes are disposed at the two ends of the bullet rack, respectively. The bullet rack is fixed to the perforating gun via the set screw.

Before a perforating operation is carried out with the perforating device in the horizontal well, the perforating bullets are disposed in the bullet holes, and the traction mechanism conveys the perforator to a designated position. The perforating bullet is ignited, resulting in an explosion that opens the formation and allows formation fluids to enter the horizontal well.

Figure 10:
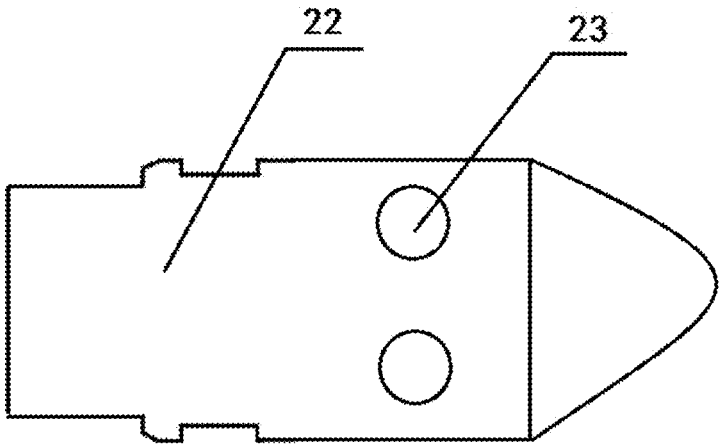
FIG. 10 is a schematic diagram of a tail segment in accordance with one embodiment of the disclosure.

As shown in FIG. 10, the tail segment comprises a body 22 and a plurality of balls 23. One end of the body 22 is in threaded connection to the perforator, and another end is a conical. The body comprises six semicircular grooves evenly distributed on an outer circumferential surface of the body. Two-thirds of each ball 23 is disposed in a corresponding semicircular groove. The opening of each semicircular groove is reduced by welding until each ball is rotatable in the corresponding semicircular groove and unremovable from the body. The moving friction state of the perforating device is changed from sliding friction to rolling friction, reducing the frictional resistance of the perforating device.

The perforating device of the disclosure is suitable for hydraulic cable-conveyed perforating in a horizontal well. When the sleeves in the horizontal well expand, shrink, deform or break, the centralizers can keep the traction mechanism in the centered state and ensure the operation stability of the traction mechanism. When the perforating device falls down in the upslope section of the horizontal well, the braking segment provides a frictional resistance to preventing the accidents from occurring, for example, preventing the perforating device from falling down in the upslope section of the horizontal well, and avoiding the damage to the cables or the perforating device. When operating in a low curvature horizontal well, the flex joint can change the rigidity of the perforating device and ensure the ability of the perforating device to convey tools downhole. When the traction mechanism breaks down, the power supply segment prevents the high voltage of from being applied to the traction mechanism, which guarantees the electrical safety of the perforating device and prevents the accident perforation of the perforating device by mistake.

It will be obvious to those skilled in the art that changes and modifications may be made, and therefore, the aim in the appended claims is to cover all such changes and modifications.

What is claimed is:

1. A device, comprising:

1) a release sub;
2) a rotating segment;
3) a first centralizer;
4) a braking segment;
5) a casing collar locator (CCL);
6) a traction mechanism;
7) a second centralizer;
8) a flex joint;
9) a power supply segment;
10) a shock absorber;
11) a perforator; and
12) a tail segment;

wherein:

the release sub is threadedly connected to the rotating segment, the rotating segment is threadedly connected to the first centralizer, the first centralizer is threadedly connected to the braking segment, the braking segment is threadedly connected to the casing collar locator, the casing collar locator is threadedly connected to the traction mechanism, the traction mechanism is threadedly connected to the second centralizer, the second centralizer is threadedly connected to the flex joint, the flex joint is threadedly connected to the power supply segment, the power supply segment is threadedly connected to the shock absorber, the shock absorber is threadedly connected to the perforator, the perforator is threadedly connected to the tail segment;

the release sub comprises a first joint assembly and a second joint assembly;

the first joint assembly comprises a first joint, a guide key, a connecting sleeve comprising a locking groove, a second joint, and an outer pipe; the second joint is in threaded connection to the outer pipe; the connecting sleeve is disposed inside the outer pipe and is connected to the first joint through the guide key;

the second joint assembly comprises a plurality of locking claws, a third joint, and a head; the plurality of locking claws corresponds to the locking groove of the first joint assembly; the plurality of locking claws is fixed on the third joint by a screw pin, and evenly disposed between the head and the third joint;

the first centralizer and the second centralizer are identical in structure, and each comprises a first connector, a second connector, a rotating shaft, a first spring sleeve, a second spring sleeve, a bearing, a supporting arm, two compression caps, two pushing rods, two springs, and four centering arms each comprising a supporting arm; the rotating shaft passes through inner holes of the first spring sleeve and the second spring sleeve, and the first connector and the second connector are disposed on both ends of the rotating shaft, respectively; the first spring sleeve and the second spring sleeve are movable back and forth on the rotation shaft, and the two springs are provided between the first and second spring sleeves and the rotating shaft, respectively; the two compression caps are in threaded connection to the first and second spring sleeves to compress the two springs, respectively; the two pushing rods are disposed on one end of the first and second spring sleeves, respectively; the four centering arms are disposed between the first spring sleeve and the second spring sleeve; one end of the supporting arm of each centering arm is fixed on one of the two pushing rods by a first steel pin, and another end is fixed on the bearing; the bearing is disposed between two supporting arms and fixed by a second steel pin;

the braking segment comprises a first brake joint, a second brake joint, and a brake control mechanism disposed between the first brake joint and the second brake joint; the brake control mechanism comprises a motor assembly, a first pushing rod, a spring, two supporting arms, a pushing block, and a brake claw;

one end of each of the two supporting arms is fixed on a center of the brake claw via a third steel pin, and another end of each of the two supporting arms is fixed on the pushing block via a fourth steel pin; the spring is disposed between the first pushing rod and the pushing block, and the first pushing rod is connected to the motor assembly.

2. The device of claim 1, wherein a number of the plurality of locking claws is three, each two of the locking claws forms an included angle of 120 degrees.

3. The device of claim 1, wherein the four entering arms are evenly distributed on the rotating shaft, each two of which forms an included angle of 90 degrees.

4. The device of claim 1, wherein the casing collar locator comprises a first magnetic joint, a probe, and a second magnetic joint; the first magnetic joint is in threaded connection to the braking segment; the probe comprises a coil winding around a soft iron core and two permanent magnetic steels, and the two permanent magnetic steels are fixed on both ends of the coil winding, respectively, with identical polar orientation.

5. The device of claim 1, wherein the traction mechanism comprises a hydraulic control system, a hydraulic pushing system and a plurality of drive sections; the hydraulic control system is a control device that pressurizes hydraulic oil in the hydraulic pushing system and transports the hydraulic oil into a hydraulic cylinder; the plurality of drive sections each comprises a primary arm, a secondary arm, a second pushing rod, a seal ring, a spring, and a hydraulic cylinder; one end of the primary arm is fixed on a corresponding drive section, and another end is connected to a driving wheel; one end of the secondary arm is connected to the primary arm, and another end is connected to the second pushing rod driving the primary arm to stretch or retract; the second pushing rod is extendable into the hydraulic cylinder; the seal ring is disposed between the second pushing rod and an inner wall of the corresponding drive section; and the spring is connected to the second pushing rod.

6. The device of claim 1, wherein the flex joint comprises a first flexible joint, a second flexible joint, and a core assembly disposed between the first flexible joint and the second flexible joint; the core assembly is disposed on a wall of the flex joint and comprises a plurality of flexible parts; each flexible part comprises a plurality of T-shaped incisions reversely connected to one another; and an area between the T-shaped incisions forms a flexible embroidery.

7. The device of claim 6, wherein the core assembly comprises five flexible parts disposed on the wall of the flex joint; each flexible part comprises four incisions reversely connected to one another; and a width of each incision is 2 mm±1 mm.

8. The device of claim 1, wherein the shock absorber comprises a first damping joint, a spring, a sliding sleeve, a second damping joint, and a retaining ring; one end of the sliding sleeve is connected to the first damping joint, and another end extends into the second damping joint; the spring is disposed outside the sliding sleeve; and the retaining ring is provided inside the second damping joint.

9. The device of claim 1, wherein the tail segment comprises a body and a plurality of balls; one end of the body is in threaded connection to the perforator, and another end is conical; the body comprises six semicircular grooves evenly distributed on an outer circumferential surface of the body; two-thirds of each ball is disposed in a corresponding semicircular groove; and each ball is rotatable in the corresponding semicircular groove and unremovable from the body.

* * * * *